US008851026B2

(12) United States Patent
Brinkmann et al.

(10) Patent No.: US 8,851,026 B2
(45) Date of Patent: Oct. 7, 2014

(54) COOLING ARRANGEMENT FOR INTERNAL COMBUSTION ENGINES

(75) Inventors: Bernd Brinkmann, Dormagen (DE); Hans Guenter Quix, Herzogenrath (DE); Jan Mehring, Cologne (DE); Heinrich Czech, Pulheim (DE); Klaus Gollek, Pulheim (DE); Peter Guenther, Dorfanger (DE)

(73) Assignee: Ford Global Technologies, LLC, Dearborn, MI (US)

( * ) Notice: Subject to any disclaimer, the term of this patent is extended or adjusted under 35 U.S.C. 154(b) by 396 days.

(21) Appl. No.: 13/162,435

(22) Filed: Jun. 16, 2011

(65) Prior Publication Data

US 2012/0006286 A1 Jan. 12, 2012

(30) Foreign Application Priority Data

Jul. 6, 2010 (DE) ..... 10 2010 017 766

(51) Int. Cl.
*F01P 11/02* (2006.01)
*F01P 7/16* (2006.01)

(52) U.S. Cl.
CPC ..... *F01P 11/0285* (2013.01); *F01P 2060/06* (2013.01); *F01P 11/029* (2013.01); *F01P 7/165* (2013.01)
USPC ..... 123/41.08; 123/41.02; 123/41.21; 123/41.54; 165/51

(58) Field of Classification Search
CPC ..... F01P 7/16; F01P 11/02; F01P 11/029; F01P 11/028
USPC ..... 123/41.01–41.03, 41.08, 41.21–41.27; 165/51
See application file for complete search history.

(56) References Cited

U.S. PATENT DOCUMENTS

| | | | | |
|---|---|---|---|---|
| 4,352,342 | A | 10/1982 | Cser | |
| 5,836,269 | A * | 11/1998 | Schneider | 123/41.1 |
| 2003/0029167 | A1 * | 2/2003 | Hudson et al. | 60/598 |
| 2007/0215073 | A1 * | 9/2007 | Lawrence et al. | 123/41.54 |
| 2009/0025416 | A1 * | 1/2009 | Murakami et al. | 62/324.6 |
| 2010/0147489 | A1 * | 6/2010 | White et al. | 165/51 |

FOREIGN PATENT DOCUMENTS

| | | | | |
|---|---|---|---|---|
| DE | 19607638 | C1 | 6/1997 | |
| DE | 10139314 | A1 | 3/2003 | |
| EP | 2039902 | A2 | 3/2009 | |
| GB | 2403163 | A * | 12/2004 | F01P 11/02 |
| GB | 2437064 | A | 10/2007 | |
| GB | 2458263 | A | 9/2009 | |
| GB | 2458264 | A | 9/2009 | |

OTHER PUBLICATIONS http://en.wikipedia.org/wiki/Orifice_plate.*

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

A cooling arrangement for an internal combustion engine is described, with a coolant balancing tank which is capable of being filled with coolant and the inlet side of which is connected via a first venting line to an internal combustion engine and/or via a second venting line to a cooler for cooling the coolant, and the outlet side of which is connected via a coolant return line to the inlet side of a pumping device for pumping the coolant through the internal combustion engine. The cooling arrangement has, furthermore, a flow control unit for variably limiting the coolant volume flow in the venting line.

15 Claims, 4 Drawing Sheets

PRIOR ART

COOLING ARRANGEMENT FOR INTERNAL COMBUSTION ENGINES

RELATED APPLICATIONS

This application claims priority to German Patent Application No. 102010017766.0, filed on Jul. 6, 2010, the entire contents of which are being incorporated herein by reference.

FIELD

The present disclosure relates to a cooling arrangement for an internal combustion engine, in particular for an internal combustion engine of a motor vehicle.

BACKGROUND AND SUMMARY

Cooling arrangements for internal combustion engines provide the intrinsic function of cooling, for example, an internal combustion engine and further components of a motor vehicle and, where appropriate, utilizing the heated coolant as a heat source for heating devices of, for example, an air conditioning system of the motor vehicle. It is likewise important for these cooling arrangements that air which is included in the cooling circuit of the cooling arrangement be regularly removed from the circuit.

Thus, in general, a balancing tank is provided in the cooling arrangement. This serves, inter alia, for separating air from the cooling circuit, for compensating the increase in volume of the coolant during heating, for filling the cooling arrangement with coolant, and for building up a pressure cushion in order to prevent the coolant from boiling. In order to vent the cooling circuit, it is possible to incorporate the balancing tank both into the internal engine circuit and into the overall cooling circuit normally routed via a thermostat.

In order to enable the coolant to flow out of the internal engine circuit to a cooler and therefore into the overall cooling circuit, a thermostat opens when the internal combustion engine or the coolant has reached a minimum desired operating temperature. The coolant stream is conventionally driven by a pump which is driven by the internal combustion engine via the crankshaft. The throughput of the pump consequently depends on the engine rotational speed.

To ensure proper venting of the cooling circuit when the pump output capacity is low, a minimum flow velocity of the coolant inside the venting lines has to be maintained. On the other hand, when the pump output capacity is high, a maximum flow velocity inside the venting lines should also not be overshot, so as to avoid foaming of the coolant and therefore an intermixing of the coolant with air or excessive lowering of the coolant level in the balancing tank.

These requirements are usually achieved by means of fixed through-flow cross sections in the venting lines, in conjunction with suitably configured balancing tanks, for example by means of deflection or baffle surfaces arranged in the tanks, by a specific shaping of the balancing tank, by the arrangement of the coolant inlet and coolant outlet ports on the balancing tank, and by the coolant volume.

Thus, a cooling arrangement for an internal combustion engine is described, for example, in GB 2 458 263 A. The coolant is pumped through the internal combustion engine by means of a circulating pump. Between the internal combustion engine and the cooler, a thermostatic valve is arranged, which opens when the coolant temperature in the internal combustion engine overshoots a predetermined temperature. Furthermore, the inlet side of a balancing tank is connected via a coolant inflow line to an upper end of the cooler, and the outlet side of the balancing tank is connected to the suction side of the pump via a coolant return line. In specific operating states, to prevent coolant from undesirably flowing back into the balancing tank via the coolant return line connected on the outlet side, a nonreturn valve is provided on the outlet side of the balancing tank. Furthermore, in another embodiment, a throughflow limiter in the form of a pressure-limiting valve is arranged in the coolant inflow line between the cooler and the balancing tank. So the pressure-limiting valve maintains a stipulated coolant operating pressure upstream of the limiting valve, to be precise, in the cylinder head of the internal combustion engine, for example, in the event of an abrupt decrease in pressure in the cooling circuit on account of a sudden change in engine rotational speed.

Furthermore, GB 2 458 264 A discloses a throughflow limiter for use in a cooling arrangement for an internal combustion engine. It is proposed, in particular, to use the through-flow limiter described in a coolant inflow line of a coolant balancing tank.

GB 2 437 064 A discloses a degassing tank for an engine cooling system. The degassing tank has a conical shape and has one or more smaller degassing chambers arranged in it. The inlet and outlet ports for the coolant are in each case arranged tangentially with respect to the degassing tank. This arrangement is intended to make it possible to carry out the degassing of the cooling system by means of a compact degassing tank in which, moreover, only a relatively small coolant quantity is stored.

On account of the nowadays preeminent requirements regarding the configuration of the engine space which generally receives the cooling arrangements of a motor vehicle, for example the provision of pedestrian protection measures, the accommodation of complex drive trains and low weight, the available construction space is greatly restricted. It is therefore especially desirable to reduce the volume of the coolant balancing tank to a minimum.

The inventors herein have recognized the above mentioned issues and have devised an approach to at least partially address them. In one embodiment, a cooling arrangement comprises a coolant balancing tank having an inlet side and an outlet side, the inlet side connected via a first venting line to an internal combustion engine and/or connected via a second venting line to a cooler, and the outlet side connected via a coolant return line to an inlet side of a pumping device. At least one of the first and second venting lines has a flow control unit for variably limiting a coolant volume flow.

In this way, a cooling arrangement for an internal combustion engine, in particular for an internal combustion engine of a motor vehicle, is provided, which has essentially a coolant balancing tank which is capable of being filled with a coolant and the inlet side of which is connected via a first venting line to an internal combustion engine and/or via a second venting line to a cooler for cooling the coolant, and the outlet side of which is connected via a coolant return line to the inlet side of a pumping device for pumping the coolant through the internal combustion engine. Furthermore, a flow control unit for variably limiting the coolant volume flow is provided in the venting line or venting lines. Preferably, each of the venting lines has a (variable) flow control unit.

Thus, satisfactory venting of the cooling circuit under all possible operating conditions is ensured, particularly also when the pump output capacity is very low. This allows the use of a substantially smaller-volume coolant balancing tank with a simple internal set-up. Since the volume flow of the coolant can be varied by means of the flow control unit during operation, the operating range in which satisfactory venting of the cooling circuit is possible can be extended in a simple way. If the extended operating range is not utilized, the cooling arrangement disclosed herein likewise makes it possible to use, instead, a substantially smaller coolant balancing tank having a simpler set-up. This requires a smaller construction space and saves weight, since the disclosed coolant balancing tank stores a smaller coolant quantity on account of the smaller volume. Moreover, as a result of the smaller coolant quantity in the cooling circuit, the optimal operating temperature of the internal combustion engine, particularly after a cold start, is reached substantially more quickly.

DETAILED DESCRIPTION

To ensure satisfactory venting of a cooling circuit, the permissible operating range of a cooling arrangement is determined essentially by the factors described below. The separation of the gaseous constituents included in the coolant from the cooling circuit depends generally on the flow velocity of the coolant in the cooling circuit. Thus, on the one hand, a minimum flow velocity of the coolant inside the venting lines is necessary in order to ensure satisfactory venting of the overall cooling circuit, but, on the other hand, too high a flow velocity leads to foaming of the coolant and therefore to increased mixing of air into the coolant and, moreover, to an excessive lowering of the coolant level in the balancing tank. Since the coolant pump which circulates the coolant in the cooling circuit is usually driven via the internal combustion engine or the crankshaft of the internal combustion engine, the flow velocity of the coolant in the case of predetermined fixed line cross sections in the cooling circuit depends directly on the output capacity of the coolant pump and therefore on the rotational speed of the engine. The permitted minimum or maximum flow velocity of the coolant and the output capacity of the coolant pump therefore determine the permissible operating range for satisfactory venting of the cooling circuit.

The variable limitation by the flow control unit, effected according to the embodiments disclosed herein, of the coolant volume flow in one or more venting lines allows the coolant flow in the venting line to be reduced or increased in a targeted manner during the operation of the cooling arrangement as a function of one or more operating parameters. Thus, according to one embodiment of the disclosure, the flow control unit is designed in such a way as to control the volume flow in the venting line as a function of an output capacity of the pumping device.

Figure 2:
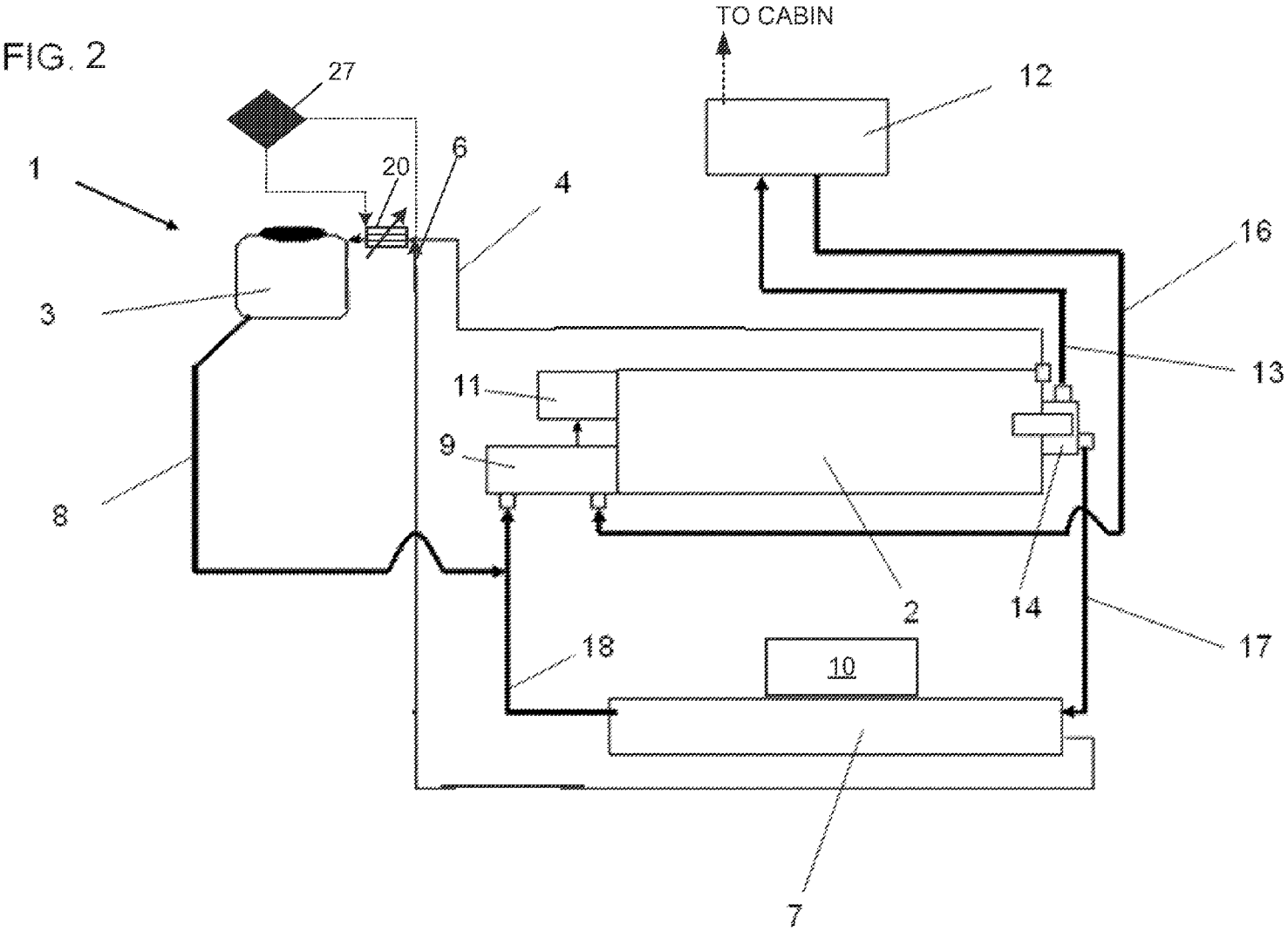
FIG. 2 shows a diagrammatic illustration of an another exemplary embodiment of the cooling arrangement according to the disclosure.
Figure 3:
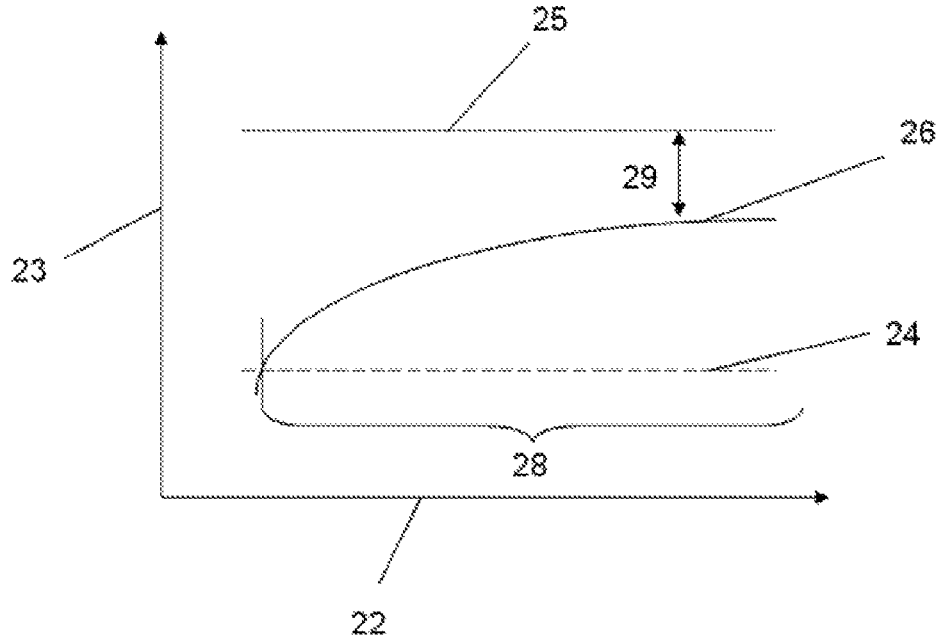
FIG. 3 shows a graph illustrating the flow velocity as a function of the output capacity of the pumping device in the embodiment illustrated in FIG. 1.
Figure 4:
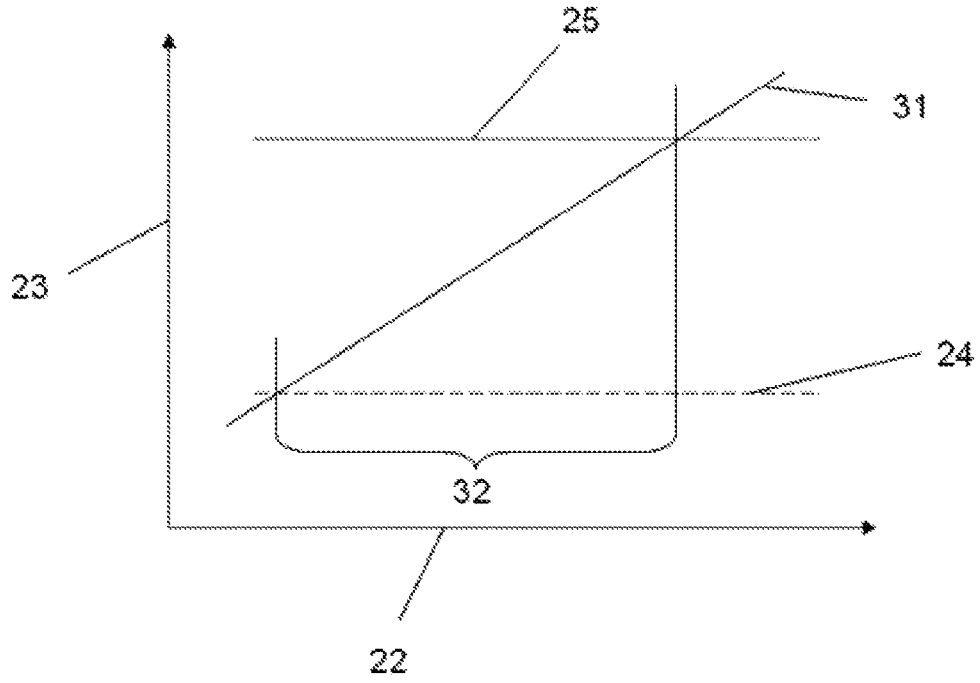
FIG. 4 shows a graph illustrating the flow velocity as a function of the output capacity of the pumping device in a cooling arrangement according to the prior art.
Figure 5:
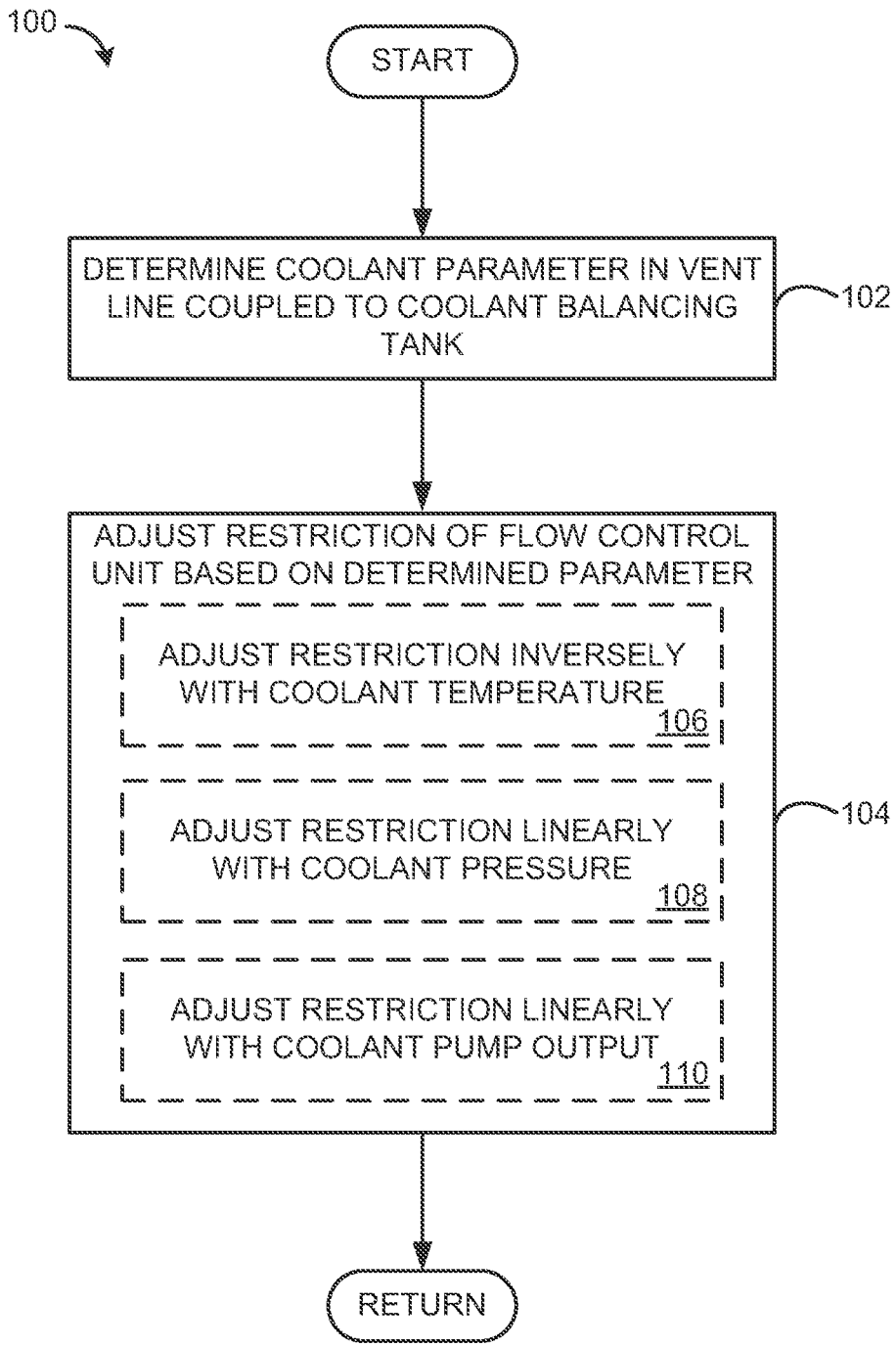
FIG. 5 is flow chart illustrating a method for controlling coolant flow according to an embodiment of the present disclosure.

The cooling arrangement described above is shown schematically in FIGS. 1 and 2. FIGS. 3 and 4 show graphs illustrating the flow velocity of various cooling systems, with FIG. 3 showing the flow velocity of a cooling system according to an embodiment of the present disclosure and FIG. 4 showing the flow velocity of cooling system according to the prior art. FIG. 5 illustrates a method for controlling coolant flow in a coolant circuit. In the various figures, identical parts are always given the same reference symbols, therefore these parts are usually also described only once.

In the context of the present disclosure, venting is to be understood as meaning any separation of all gaseous constituents bound in the coolant from the coolant or from the cooling circuit. To simplify the following description, it may be pointed out that the following use of the term "venting line" in the singular is to be understood as not merely referring to a single venting line of the cooling arrangement, but also embraces further venting lines, insofar as these are provided in an embodiment of the cooling arrangement according to the disclosure, this being the case, for example, when the inlet side of the coolant balancing tank is connected via one venting line to the internal combustion engine and via a further venting line to the cooler.

Figure 1:
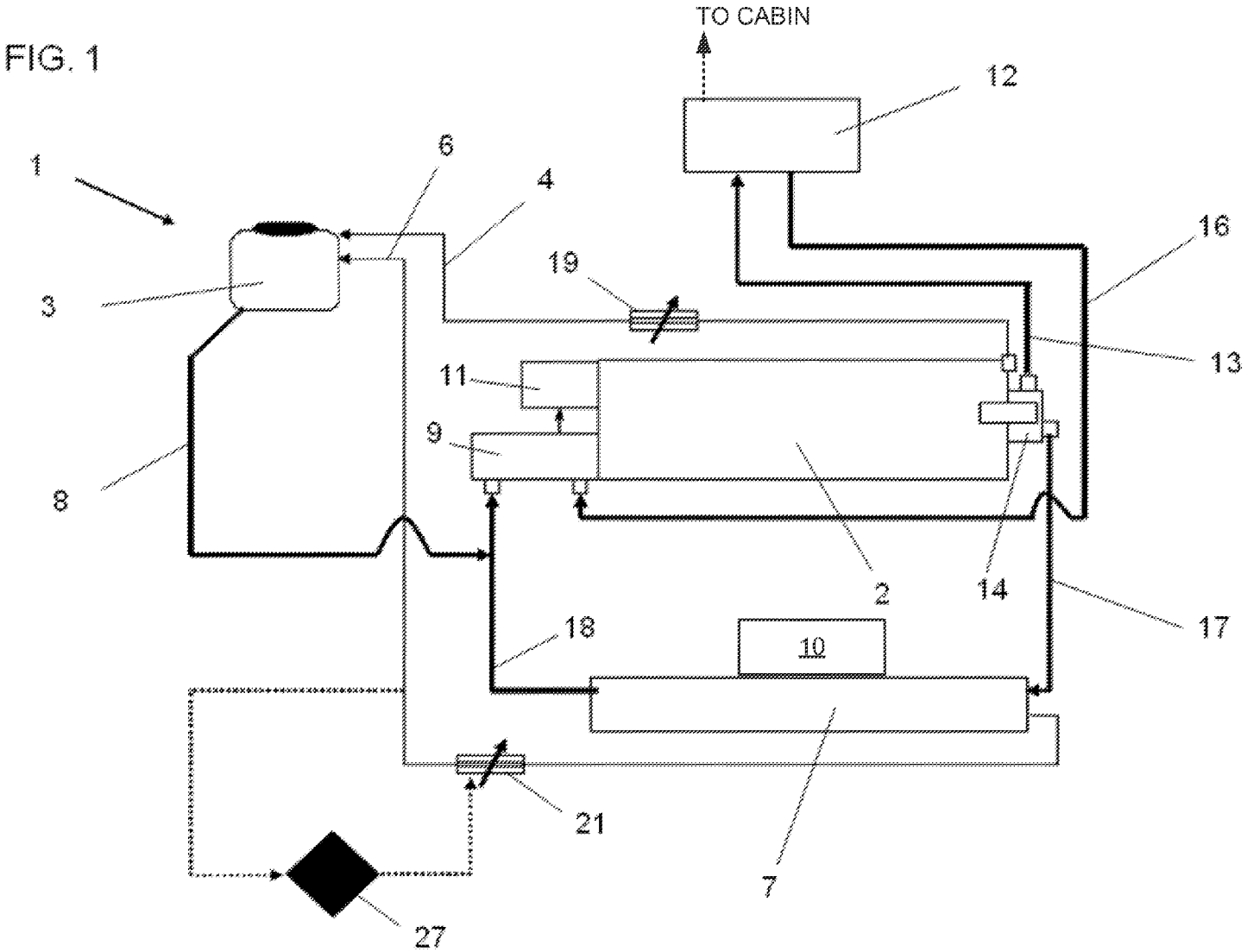
FIG. 1 shows a diagrammatic illustration of an exemplary embodiment of the cooling arrangement according to the disclosure.

FIG. 1 illustrates diagrammatically a preferred embodiment of a cooling arrangement 1, by way of example, for a motor vehicle with an internal combustion engine 2. The cooling arrangement 1 comprises a coolant balancing tank 3 which is fluidically coupled on its inlet side via a first venting line 4 to the internal combustion engine 2. Furthermore, in the exemplary embodiment illustrated, the coolant balancing tank 3 is fluidically coupled on its inlet side via a second venting line 6 to a cooler 7. The outlet side of the coolant balancing tank 3 is fluidically coupled via a coolant return line 8 and via a thermostat 9 to the inlet side of a pumping device 11. In some embodiments, the coolant balancing tank 3 may be a degas bottle, and may be positioned in the vertically highest position (with respect to gravity, for example) of the cooling arrangement 1 when mounted in a vehicle traveling on a road, in order to enable dissipation of air bubbles in contained in the coolant within the cooling arrangement 1.

The cooling arrangement 1 illustrated in FIG. 1 has an internal cooling circuit separable from the overall cooling circuit by means of the thermostat 9. The internal cooling circuit is formed by the internal combustion engine 2, a heating device 12 which is connected on its inlet side via a first coolant line 13 to the outlet side 14 of the internal combustion engine 2 and is provided for the heating of a vehicle interior by directing air flow, indicated by the dashed arrow, to the vehicle cabin, by the thermostat 9 which is connected on its inlet side via a second coolant line 16 to the outlet side of the heating device 12, and by the pumping device 11, the inlet side of which is connected to the outlet side of the thermostat 9 and which is provided for circulating the coolant through the coolant circuit. The pumping device 11 is driven via the internal combustion engine 2, that is to say the coolant throughput through the pumping device 11 or the output capacity of the pumping device 11 depends essentially on the rotational speed of the internal combustion engine 2.

During a cold start of the internal combustion engine 2, that is to say before a minimum operating temperature of the coolant or of the internal combustion engine 2 is reached, the thermostat 9 is closed. This leads to a rapid heating of the coolant (shortening of the warm-up phase). After the minimum operating temperature of the internal combustion engine 2 or of the coolant is reached, the thermostat 9 opens and allows the coolant to circulate through the overall cooling circuit.

In the overall cooling circuit, in addition to the internal cooling circuit, the coolant flows through the cooler 7, which is connected on its inlet side via a third coolant line 17 to the outlet side 14 of the internal combustion engine 2, and subsequently back again to the thermostat 9 which is connected on its inlet side via a fourth coolant line 18 to the outlet side of the cooler 7. The cooler 7 serves for cooling the coolant in that the heat carried along by the coolant is discharged into the surroundings. In some embodiments, the cooler may be a radiator coupled to a fan 10, the fan controlled by an engine control unit, such as controller 27, to dissipate heat from the radiator to the surroundings while the vehicle is not in motion, for example.

As illustrated in FIG. 1, the heating device 12 is integrated into the internal cooling circuit. The heating capacity for heating the vehicle interior is therefore available very quickly after the internal combustion engine 2 has been started. However, the heating device 12 could instead also be integrated into the overall cooling circuit and not be connected to the internal cooling circuit. The heating capacity would then be available for heating the vehicle interior after the opening of the thermostat 9, that is to say after the minimum operating temperature of the coolant or of the internal combustion engine 2 has been reached. As can be seen in FIG. 1, a respective flow control unit 19 and 21 is arranged in each of the venting lines 4 and 6. The flow control units 19 and 21 may, however, also be arranged on the outlet side 8 of the coolant balancing tank 3. If the flow control units 19 and 21 are arranged on the inlet side of the coolant balancing tank 3, it is possible to use one flow control unit for controlling the volume flows in both venting lines 4 and 6, as shown in FIG. 2. For this purpose, the venting lines 4 and 6 are routed via one common inlet connection piece into the coolant balancing tank 3 on which, for example, a single flow control unit 20 would then be arranged.

In the exemplary embodiment described in FIG. 1, the flow control units 19 and 21 are designed in such a way as to limit the coolant volume flow in each case in the venting lines 4 and 6 variably during the operation of the cooling arrangement 1. In particular, the flow control units 19 and 21 are designed for controlling the volume flow in the venting line 4 or 6 as a function of the output capacity of the pumping device 11 and therefore essentially as a function of the rotational speed of the internal combustion engine 2. The flow control units 19 and 21 have an orifice that is configured to change its restriction (e.g. change its diameter) based on one or more coolant parameters. Example control parameters include coolant temperature, coolant pressure, and coolant pumping device output. In this way, coolant flow through the control units to the coolant balancing tank may be regulated in response to various parameters to achieve a desired coolant volume flow.

The flow control units 19 and 21 may be controlled by a controller 27. While one controller 27 is shown in FIG. 1, it is to be understood that in one embodiment, one controller may control both flow control units, while in another embodiment, each flow control unit may be controlled by a separate controller. The controller 27 may be electronic or mechanical. An electronic controller may determine the coolant parameter in each venting line 4, 6 based on one more sensors (not shown) located in the vent lines. The electronic controller may then send a signal to regulate the size of each orifice diameter to maintain the coolant flow volume in each venting line 4, 6 at a desired level. A mechanical controller may actuate the flow control units mechanically based on the pressure of coolant in the vent lines.

The functioning of the flow control units 19 and 21 will be described in more detail with respect to FIG. 3 below. Since, in the exemplary embodiment shown by way of example in FIG. 1, the flow control units 19 and 21 function essentially identically, the functioning of the flow control unit 21 is described below and also applies to the same extent to the flow control unit 19.

The functioning of the flow control unit 21 of the exemplary embodiment described is illustrated in a graph in FIG. 3. This illustrates the flow velocity and therefore the volume flow of the coolant in the venting line 6 as a function of the output capacity of the pumping device 11. In FIG. 3, the abscissa 22 illustrates the pump output capacity and the ordinate 23 illustrates the flow velocity of the coolant in the venting line 6. The direction of the increasing values is indicated in each case by a corresponding arrow of the coordinate axis.

The line 24 illustrated by dashes in FIG. 3 indicates the minimum flow velocity from which satisfactory venting of the overall cooling circuit is ensured. The dotted line 25 in FIG. 3 illustrates the maximum flow velocity of the coolant up to which no foaming of the coolant and no excessive lowering of the coolant level from the coolant balancing tank 3 occur. Within the limits of the coolant flow velocity which are defined by the lines 24 and 25, satisfactory venting of the overall cooling circuit is therefore ensured.

The curve 26, which illustrates the flow velocity as a function of the pump output capacity in FIG. 3, shows that, in the event of an increase in the output capacity of the pumping device 11, the coolant flow velocity does not increase to the same extent as the pump output capacity rises. The flow control unit 21 is designed in such a way as, for example, to reduce the effective diameter of the venting line 6 with a rising output capacity of the pumping device 11, in order thereby to reduce the flow velocity of the coolant in the venting line 6. Conversely, the flow control unit 21 is designed for increasing the effective diameter with a decreasing output capacity of the pumping device 11, in order thereby to increase the flow velocity of the coolant in the venting line 6. The flow control unit 21 therefore essentially counteracts the increase or decrease in the flow velocity of the coolant which is caused by the increase or decrease in the pump output capacity. Consequently, by means of the flow control unit 21, the operating range of the cooling arrangement 1 is extended.

The flow control unit 21 may be regulated to a stipulated desired value of the coolant volume flow either mechanically or electronically. For example, the controller 27 for the flow control unit 21 detects the actual value of the current volume flow as an input variable and feeds it to the flow control unit 21.

As can be seen in FIG. 3, the curly bracket 28 indicates the permissible operating range of the cooling arrangement 1. In this operating range, the flow velocity of the coolant can be controlled by the flow control unit 21 within the limits defined by the lines 24 and 25, thus ensuring satisfactory venting of the overall cooling circuit. As may likewise be gathered from FIG. 3, in the overall permissible operating range 28 the curve 26 is at least at a distance 29 from the maximum flow velocity 25. Consequently, the permissible maximum flow velocity of the cooling arrangement 1, illustrated in FIG. 1, can be lowered by the value 29, without the venting capacity of the cooling arrangement 1 being reduced or no longer being ensured. The reduction in the maximum flow velocity makes it possible to use a smaller-volume coolant balancing tank 3 with a simple internal set-up in the cooling arrangement 1, that is to say, for example, without complex deflection or baffle surfaces.

As is also to be gathered from the curve 26, in the exemplary embodiment illustrated, the flow control unit 21 controls the volume flow of the venting line 6 continuously. That is to say, the flow control unit 21 continuously detects the output capacity of the pumping device 11 during the operation of the cooling arrangement 1 and controls the volume flow according to the value detected. The continuous control of the volume flow makes it possible to react as rapidly as possible to changed operating conditions and ensures that the cooling arrangement operates reliably.

The advantages of the cooling arrangement 1 become even clearer when compared with a conventional cooling arrangement which has no variable flow control unit. FIG. 4 illustrates the flow velocity of the coolant as a function of the output capacity of a pumping device of the cooling arrangement according to the prior art. Since this cooling arrangement has only fixed line cross sections of the coolant lines, the flow velocity of the coolant rises essentially proportionally to the output capacity of the pumping device, as can be seen clearly from the curve 31. Consequently, the point at which the flow velocity 31 reaches the maximum permissible flow velocity 25 is reached substantially more quickly, in comparison with the cooling arrangement 1 according to the disclosure, as can easily be seen from a direct comparison of the graphs in FIGS. 3 and 4. The permissible operating range 28 of the cooling arrangement 1 according to the disclosure is therefore extended substantially in relation to the operating range 32 of the cooling arrangement according to the prior art.

In a preferred version, the cooling arrangement disclosed herein is used for the cooling of an internal combustion engine of a motor vehicle.

Turning to FIG. 5, a flow chart is depicted illustrating a method 100 for controlling coolant flow in a cooling circuit, such as the coolant circuit described with reference to FIG. 1. Method 100 comprises, at 102, determining a coolant parameter in a vent line coupled to a coolant balancing tank. Example coolant parameters include coolant temperature, coolant pressure, and output of a coolant pump that pumps coolant through the coolant circuit. The coolant parameter may be determined by a controller based on one or more signals from sensors located in the vent line. At 104, a hydraulic restriction of an orifice of a flow control unit positioned in the vent line is adjusted based on the determined coolant parameter. The hydraulic restriction of the flow control unit may be adjusted based on a signal received from the controller. Example adjustments include adjusting the restriction inversely with coolant temperature at 106, adjusting the restriction linearly with coolant pressure at 108, and adjusting the restriction linearly with coolant pump output at 110. For example, in one embodiment, the coolant balancing tank may have an outlet connected to the coolant pump, and thus supply the pump with coolant to pump through the coolant circuit. Therefore, the hydraulic restriction of the flow control unit may decrease (e.g. a size of an orifice diameter may increase to lessen the hydraulic restriction) as the temperature of the coolant increases, as the maximum permissible velocity 25 increases with increasing temperature due to, for example, the viscosity reduction with increasing temperature, leading to lower risk of foaming and draw down of the bottle level. Thus, to maximize the degassing performance especially under high engine load condition (exhaust gas, especially in diesel engines, may enter the cooling system through the cylinder head gasket) it may be useful to increase the flow rate over the venting lines at high coolant temperature. Conversely, as the coolant pressure increases, the restriction may increase (e.g. a diameter of the flow control unit may decrease) to limit the flow rate through the degas line at a certain level. Likewise, the restriction may increase (by decreasing the orifice diameter) as the pump output increases, or the restriction may decrease (by increasing the orifice diameter) as the pump output decreases, in order to maintain the coolant flow velocity at a constant level, and within the upper and lower limits of velocity allowable for satisfactory venting of the coolant, as described with respect to FIG. 3.

The embodiments described herein may provide many advantages. Especially advantageously, the volume flow of the coolant in the venting line is raised when the output capacity of the pumping device is low, for example by increasing the effective line cross section of the venting line by means of the flow control unit. This ensures the minimum flow velocity for satisfactory venting of the cooling circuit even in the case of a low throughput of the pumping device, with the result that the permissible operating range of the cooling arrangement for satisfactory venting of the cooling circuit is extended downward. Furthermore, the venting of the cooling circuit afforded by the disclosed embodiments makes it possible especially advantageously, even in the case of a low output capacity of the pumping device, for example, to use an electric coolant pump which is operated in the low-load or part-load range for circulating the coolant in the cooling circuit. Thus, for example, the use of electric low-energy pumps may also be envisaged.

On the other hand, in the case of a high output capacity of the pumping device, the volume flow is advantageously reduced, for example by reducing the effective line cross section of the venting line by means of the flow control unit, in order to keep the flow velocity of the coolant substantially below the maximum permissible flow velocity. As a result, the permissible maximum flow velocity for satisfactory venting of the cooling circuit is not reached or is not overshot even in the case of a high throughput of the pumping device, and therefore the permissible operating range of the cooling arrangement for satisfactory venting of the cooling circuit is likewise extended upward.

In an especially advantageous refinement of the disclosed cooling arrangement, the flow control unit is designed for controlling the volume flow in the venting line, over the entire operating range of the cooling arrangement, substantially below the permissible minimum flow velocity. As a result, as compared with conventional cooling arrangements, the disclosed cooling arrangement makes it possible to use a substantially smaller-volume coolant balancing tank, with the result that the construction space required for the cooling arrangement and the coolant quantity stored in the balancing tank and therefore also the weight are reduced. Moreover, because of the smaller coolant quantity in the cooling circuit, the optimal operating temperature of the internal combustion engine, particularly after a cold start, is reached substantially more quickly.

Especially preferably, the flow control unit is designed in such a way as to keep the volume flow in the venting line virtually constant over the entire operating range of the cooling arrangement, for example by an appropriate adaptation of the effective line cross section of the venting line, so that a stipulated virtually constant optimal volume flow is achieved in the venting line as a function of the instantaneous separating state of the cooling arrangement. Optimal venting capacity of the cooling arrangement is thereby afforded. Furthermore, the use of a substantially smaller-volume coolant balancing tank is made possible, with the result that the construction space required for the cooling arrangement and the coolant quantity stored in the balancing tank and therefore also the weight are reduced. Moreover, because of the smaller coolant quantity in the cooling circuit, the optimal operating temperature of the internal combustion engine, particularly after a cold start, is reached substantially more quickly.

Furthermore, according to a further advantageous refinement, in addition to the output capacity of the pumping device, the flow control unit is designed for controlling the volume flow in the venting line as a function of the coolant temperature and/or of the coolant pressure. Thus, this refinement of the cooling arrangement according to the disclosure makes it possible not only to ensure satisfactory venting of the cooling circuit, but also to provide an optimal cooling capacity for the internal combustion engine. In the case of a raised coolant temperature, for example, the volume flow can be increased in order to allow for better degassing performance of the balancing tank. On the other hand, in the case of a low coolant temperature, the volume flow can be reduced, for example to zero, in order thereby to achieve a more rapid heating of the coolant and consequently a more rapid reaching of the optimal operating temperature of the internal combustion engine (shortening of the warm-up phase).

Especially preferably, the flow control unit is designed for carrying out the control of the volume flow continuously, that is to say, during the operation of the cooling arrangement, the flow control unit continuously detects one or more operating parameters and controls the volume flow, for example by varying the effective coolant line cross section, according to the detected parameter value, in such a way that the volume flow always assumes a value between the permissible minimum and maximum flow velocities, in order to ensure satisfactory venting of the cooling circuit in all operating states. The continuous control of the volume flow makes it possible to react as rapidly as possible to changed operating conditions and ensures that the cooling arrangement operates reliably.

In one embodiment disclosed herein, the flow control unit is arranged in the venting line. This offers the great advantage that the volume flow in each venting line can be controlled individually. Thus, for example, it is conceivable to prevent venting via the venting line arranged between the coolant balancing tank and the internal combustion engine, for example, temporarily and in the case of specific operating states of the internal combustion engine, which may be especially advantageous during a cold start, in order to achieve as rapid a heating of the coolant as possible in the internal cooling circuit and consequently a rapid reaching of the optimal operating temperature of the internal combustion engine. The individual control of the volume flows in the respective venting lines likewise makes it possible to have a venting and a cooling capacity adapted optimally to the local operating states of the components connected to the coolant balancing tank via the venting lines.

In another embodiment, the flow control unit may be arranged at an inlet port of the venting line into the coolant balancing tank. If a plurality of venting lines are connected on the inlet side to the coolant balancing tank, it is especially preferable to connect these to the balancing tank via one common inlet device, for example one common inlet connection piece, so that a single flow control unit is advantageously provided on the coolant balancing tank, in order to control the volume flow for all the connected venting lines simultaneously. Thus, an especially compact cooling arrangement is provided, which nevertheless affords the already-mentioned advantages with regard to optimal venting and cooling capacity. A flow control unit which controls the respective volume flow may, of course, also be provided in each case at each inlet connection piece, both flow control units also being switchable by control technology such that mutually coordinated volume control can be achieved.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

LIST OF REFERENCE SYMBOLS

1 Cooling arrangement
2 Internal combustion engine
3 Coolant balancing tank
4 First venting line
5 Second venting line
6 Cooler
7 Coolant return line
8 Thermostat
9 Fan
10 Pumping device
11 Heating device
12 First coolant line
13 Outlet side of 2
14 Second coolant line
15 Third coolant line
16 Fourth coolant line
17 First flow control unit (variable) in 4
18 Flow control unit in common inlet line
19 Second flow control unit (variable) in 6
20 Abscissa: Output capacity of the pumping device
21 Ordinate: Flow velocity
22 Minimum flow velocity
23 Maximum flow velocity
24 Controlled flow velocity
25 Controller
26 Permissible operating range
27 Lowering of the maximum flow velocity
28 Non-controlled flow velocity according to the prior art
29 Permissible operating range according to the prior art

The invention claimed is:

1. A cooling arrangement comprising a coolant balancing tank having an inlet side and an outlet side, the inlet side connected via a first venting line to an internal combustion engine and connected via a second venting line to a cooler, and the outlet side connected via a coolant return line to an inlet side of a pumping device wherein at least one of the first and second venting lines has a flow control unit controlled by an electronic controller to variably limit a coolant volume flow in its respective venting line as a function of flow rate of the pumping device.

2. The cooling arrangement as claimed in claim 1, wherein each of the first and second venting lines has a flow control unit for variably limiting the coolant volume flow.

3. The cooling arrangement as claimed in claim 1, wherein a hydraulic restriction of the flow control unit increases in response to increased pump device flow rate and decreases in response to decreased pumping device flow rate.

4. The cooling arrangement as claimed in claim 1, wherein the flow control unit maintains the coolant volume flow in its respective venting line at a constant level.

5. The cooling arrangement as claimed in claim 1, wherein the flow control unit controls the coolant volume flow in its respective venting line continuously by continuously detecting the flow rate of the pumping device during operation of the cooling arrangement and controlling the coolant volume flow according to the detected flow rate, the flow rate of the pump device a function of the speed of the engine.

6. The cooling arrangement as claimed in claim 1, wherein the flow control unit is arranged in its respective venting line.

7. The cooling arrangement as claimed in claim 1, wherein the flow control unit is arranged at an inlet port of its respective venting line into the coolant balancing tank.

8. The cooling arrangement as claimed in claim 1, wherein the flow control unit is arranged at a common inlet port of the first and second venting lines into the coolant balancing tank.

9. A method of controlling coolant pumped by a coolant pump in an engine, comprising:

during operation of the coolant pump, adjusting, via an electronic controller, coolant flow volume to a coolant balancing tank by adjusting a hydraulic restriction of at least one flow control unit in response to coolant pressure, the at least one flow control unit fluidically coupled to the coolant balancing tank;

wherein the coolant balancing tank is coupled on its inlet side to the engine via a first vent line and to a cooler via a second vent line, and is coupled on its outlet side to an inlet side of the coolant pump; and wherein the at least one flow control unit comprises a flow control unit arranged in each of the first and second vent lines.

10. The method of claim 9, wherein the hydraulic restriction of each flow control unit is controlled by a controller in response to the coolant pressure in a respective vent line.

11. The method of claim 10, wherein the hydraulic restriction of each flow control unit increases or decreases linearly in response to coolant pressure.

12. The method of claim 9, wherein the first and second vent lines merge into a common inlet line, the at least one flow control unit arranged in the common inlet line.

13. A coolant system, comprising:

an engine;

a coolant balancing tank including an inlet and an outlet, the inlet fluidically coupled to the engine via a first venting line;

a cooler fluidically coupled to the coolant balancing tank inlet via a second venting line;

a coolant pumping device fluidically coupled to the coolant balancing tank outlet;

a flow control unit positioned in each of the first and second venting lines to variably control a coolant flow volume in each venting line; and a controller to:

determine a coolant pressure in each of the first and second venting lines based on feedback from one or more sensors, and regulate a size of each orifice diameter of each flow control unit based on the coolant pressure to variably control the coolant flow volume in each venting line.

14. The coolant system of claim 13, wherein the coolant pressure is a function of coolant throughput through the coolant pumping device, the coolant throughput a function of a speed of the engine.

15. The coolant system of claim 13, wherein the coolant balancing tank is a degas bottle.

* * * * *